US011512671B1

(12) United States Patent
Williams

(10) Patent No.: US 11,512,671 B1
(45) Date of Patent: Nov. 29, 2022

(54) HYDROGEN OXYGEN GENERATOR FOR VEHICLES

(71) Applicant: Floyd E. Williams, Grand Junction, CO (US)

(72) Inventor: Floyd E. Williams, Grand Junction, CO (US)

( * ) Notice: Subject to any disclaimer, the term of this patent is extended or adjusted under 35 U.S.C. 154(b) by 0 days.

(21) Appl. No.: 17/562,636

(22) Filed: Dec. 27, 2021

(51) Int. Cl.
*F02B 47/02* (2006.01)
*F02M 25/12* (2006.01)

(52) U.S. Cl.
CPC ..... *F02M 25/12* (2013.01)

(58) Field of Classification Search
CPC combination set(s) only.
See application file for complete search history.

(56) References Cited

U.S. PATENT DOCUMENTS 4,351,289 A * 9/1982 Renda ..... F02D 19/12 123/25 J
4,671,215 A * 6/1987 Waechter ..... F02M 25/0225 123/25 A
6,508,210 B2 * 1/2003 Knowlton ..... H01M 8/0612 123/3
2009/0000593 A1 * 1/2009 Parsons ..... F02M 25/025 123/25 C
2011/0209772 A1 * 9/2011 Woiken ..... F16L 55/02754 138/155
2012/0266592 A1 * 10/2012 Foy ..... F02M 25/12 60/599

FOREIGN PATENT DOCUMENTS

WO WO-2019153037 A1 * 8/2019 ..... C25B 1/08

* cited by examiner

*Primary Examiner* — George C Jin
*Assistant Examiner* — Teuta B Holbrook
(74) *Attorney, Agent, or Firm* — Edwin H. Crabtree; Ramon L. Pizarro

(57) ABSTRACT

A hydrogen oxygen generator used for converting water to hydrogen and oxygen, which is mixed with fuel to a vehicle engine for improved mileage and cleaner burning fuel. The generator includes a generator housing with a water line adapter connected to a threaded water line nipple. The generator housing is adapted for mounting to a side of an engine air duct manifold. A water line, connected to a water container, provides water to the threaded water line nipple. The water line nipple includes a small orifice. When the water passes through the orifice in the generator housing, a venture effect is created and the water is converted to hydrogen gas and oxygen gas. The two gases pass now through a threaded gas nipple in the side of the generator housing, into the engine manifold, and then mixed with the engine fuel.

9 Claims, 3 Drawing Sheets

HYDROGEN OXYGEN GENERATOR FOR VEHICLES

BACKGROUND OF THE INVENTION

(a) Field of the Invention

This invention relates to a hydrogen oxygen generator and more particularly, but not by way of limitation, to a hydrogen oxygen generator for converting water to hydrogen gas and oxygen gas. The two gases are introduced into a vehicle engine manifold for mixing with engine fuel in the engine. The generator can be used with both diesel and gasoline engines.

(b) Discussion of Prior Art

Heretofore, there have been many different designs of engine carburetors for improved gas and diesel engine combustion. None of these prior art carburetors provide for creating hydrogen and oxygen from water for more efficient engine performance.

SUMMARY OF THE INVENTION

In view of the foregoing, it is a primary objective of the subject invention to use water converted to hydrogen gas and oxygen gas for mixing with engine fuel.

Another object of the invention is by creating hydrogen and oxygen mixed with engine fuel, mileage of the vehicle is increased in a range of 10 to 20 percent.

Yet another object of the invention is the hydrogen oxygen generator provides for cleaning burning fuel, a cleaner engine, and improved engine maintenance.

The hydrogen oxygen generator includes a generator housing with a water hose adapter, with barbs, and a threaded water line nipple. The generator housing is adapted for mounting to a side of an engine air duct manifold. A water line, connected to a water container, provides water to the threaded water line nipple. The water line nipple includes a small orifice. When the water passes through the orifice in the generator housing, a venturi effect is created and the water is converted to hydrogen gas and oxygen gas. The two gases pass now through a threaded gas nipple in a side of the generator housing, into the engine manifold, and mix with the engine fuel.

These and other objects of the present invention will become apparent to those familiar with various types of vehicle engines and fuel carburetors when reviewing the following detailed description, showing novel construction, combination, and elements as herein described, and more particularly defined by the claims, it being understood that changes in the embodiments to the herein disclosed invention are meant to be included as coming within the scope of the claims, except insofar as they may be precluded by the prior art.

BRIEF DESCRIPTION OF THE DRAWINGS

The accompanying drawings illustrate complete preferred embodiments in the present invention according to the best modes devised for the practical application of the subject hydrogen oxygen generator, and in which.

DETAILED DESCRIPTION OF THE PREFERRED EMBODIMENTS

Figure 1:
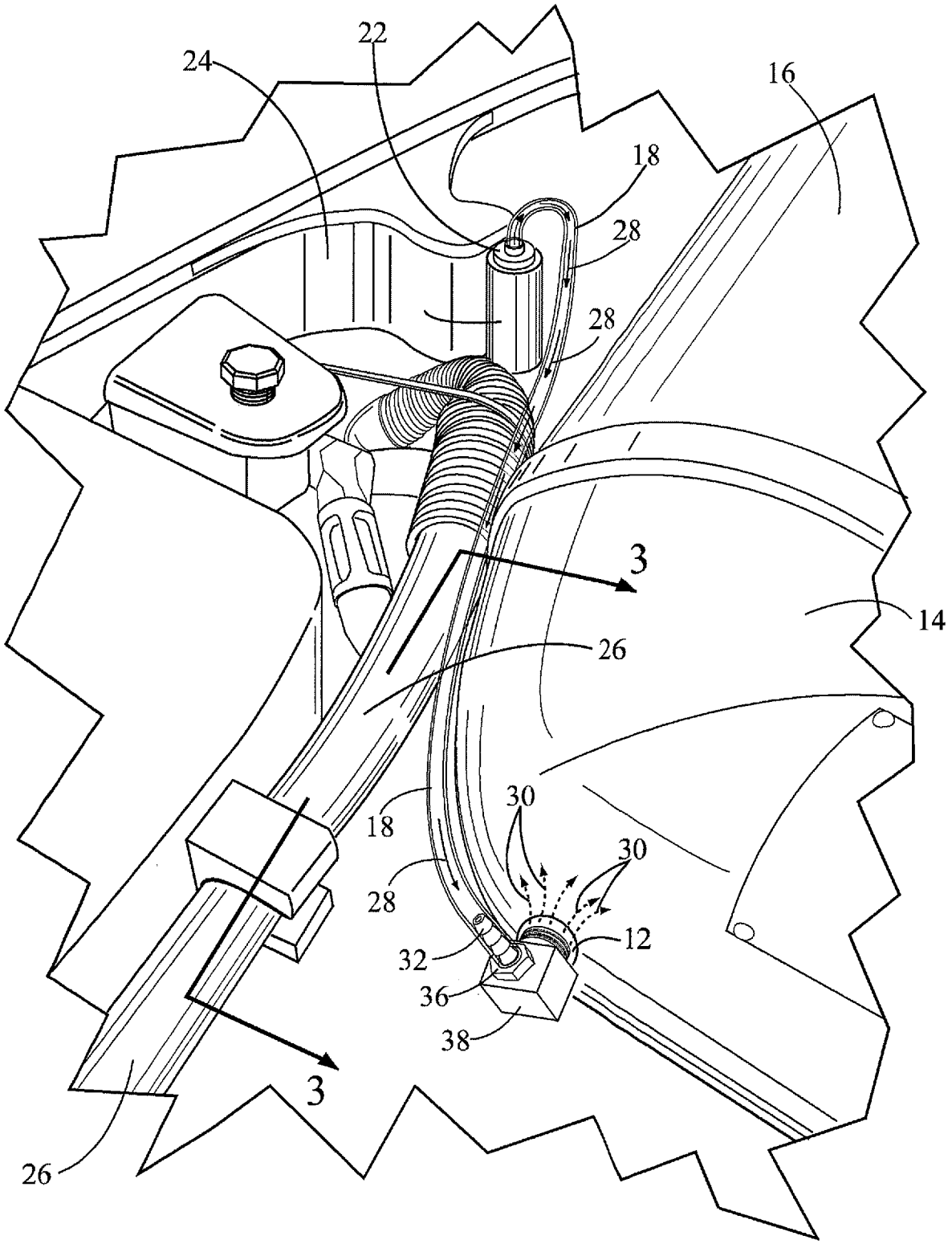
FIG. 1 is a perspective view of the hydrogen oxygen generator attached to an engine manifold.

In FIG. 1, the subject hydrogen oxygen generator is shown having a general reference numeral 10. The generator 10, with a rubber grommet 12, is attached to a side of an engine air duct manifold 14. The manifold 14 is part of a vehicle engine 16. Also shown in this drawing is a water line 18 connected to the generator 10 and connected to a water container 20, with a water cap 22. The water container 20 is disposed next to a radiator 24 and radiator hose 26. In this drawing, arrows 28 illustrate water flowing from the container 20, through the water line 18, and into the generator 10. Also shown in this drawing are dashed arrows 30 illustrating the hydrogen gas and the oxygen gas introduced into the manifold 14. The water 28 is drawn into the water line 18 and the generator 10 using a vacuum produced from the engine 16 and manifold 16.

Figure 2:
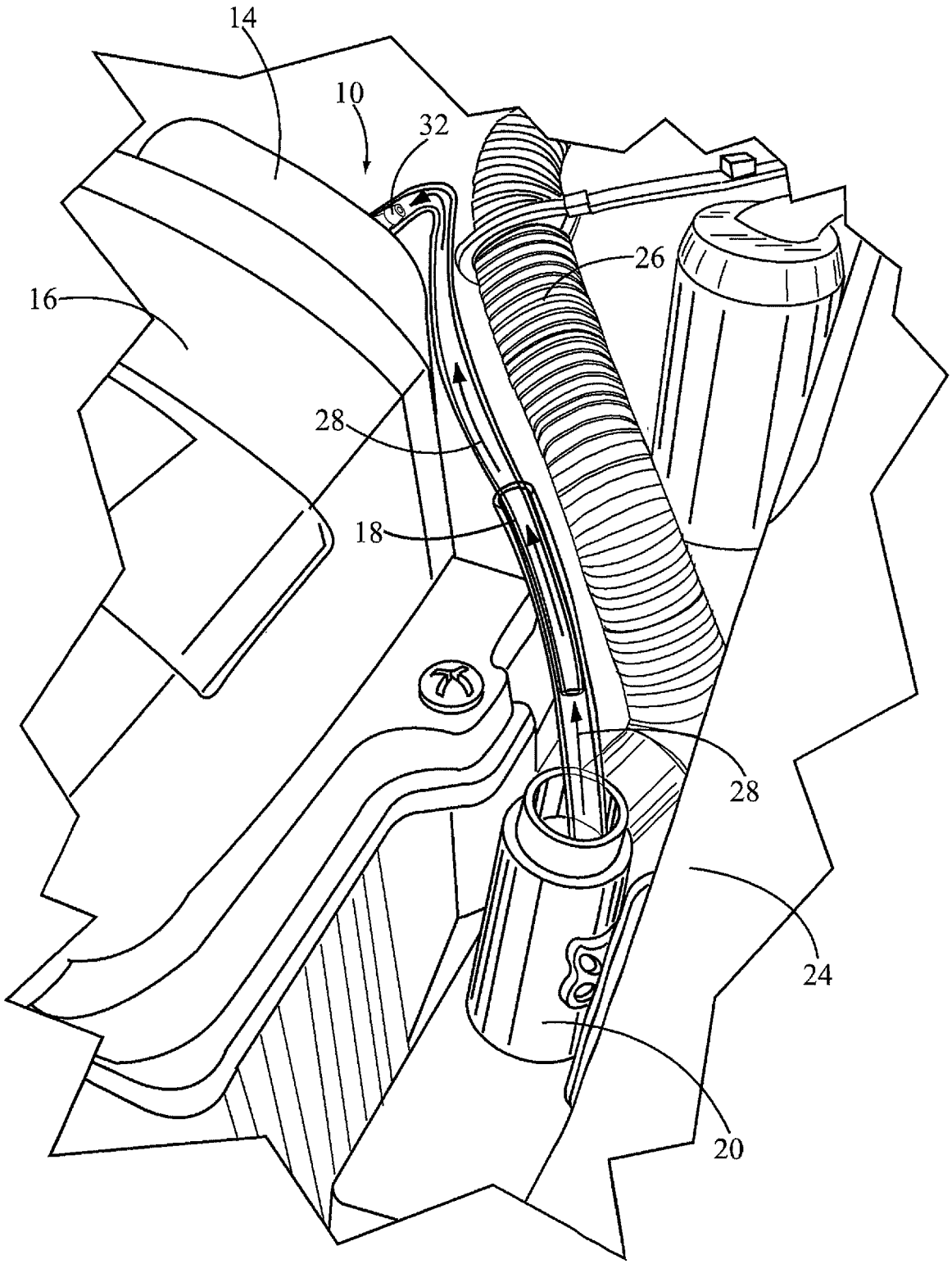
FIG. 2 is another perspective view illustrating a water container and water tube next to an engine radiator.

In FIG. 2, the water cap 22 is removed to illustrate a portion of the water line 18 inserted inside the container 20. The water can be distilled to remove chemicals and impurities. Typically, the container is 10 to 12 ounces in size and greater to provide enough water for a 20 gallon fuel tank. As mentioned above, the 10 to 12 ounce size container provides enough water for converting to hydrogen and oxygen for increased fuel mileage from 10 to 20 percent.

Figure 3:
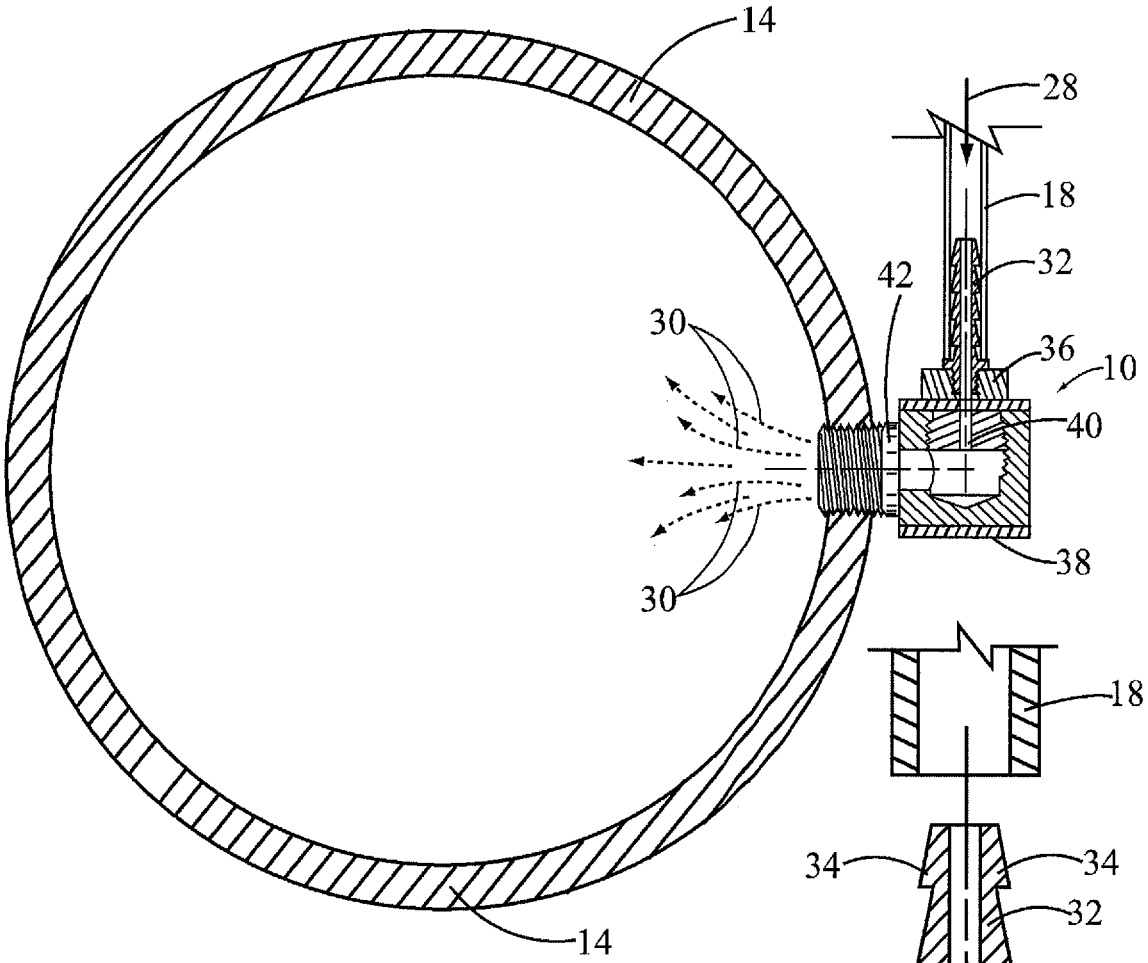
FIG. 3 is a top view of the hydrogen oxygen generator connected to the engine air duct manifold. The manifold is shown in cross section.

In FIG. 3, a top view of the hydrogen oxygen generator 10 is shown in cross section, taken along lines 3-3 in FIG. 1, and connected to the engine air duct manifold 14. The manifold is also shown in cross section and is approximately 4 inches in diameter.

In this drawing, the water line 18 is shown connected to a water line adapter 32. The adapter having with barbs 34 along its length for holding the water line in place. The water line 18 is ½ inch in diameter. The water line adapter 32 is connected to a threaded water line nipple 36 threaded inside a generator housing 38. The water line nipple 36 includes a small orifice 40, shown in FIGS. 4 and 5. The orifice 40 typically is in a range of 0.005 to 0.015 inches in size and more specifically 0.010 in size. The small orifice 40 is important in that it creates a venturi effect for turning the water into hydrogen gas and oxygen gas. The two gases pass through a threaded gas nipple 42 threaded into a side of the generator housing 38 and threaded into the manifold 14.

Figure 4:
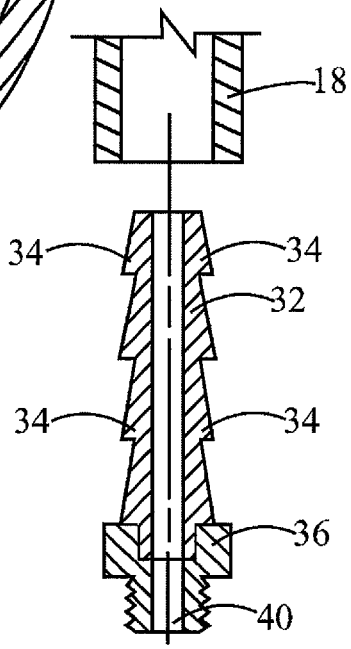
FIG. 4 is an enlarged view of a water hose adapter with barbs and a threaded water line nipple.

In FIG. 4, an enlarged view of a portion of the water line 18 is shown positioned for attachment to the water line adapter 32. The water line adapter 32 is attached to a top of the water line nipple 36.

Figure 5:
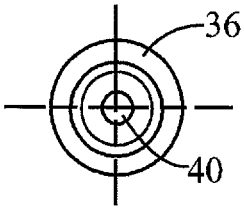
FIG. 5 is an enlarged bottom view of the water line nipple with orifice.

In FIG. 5, an enlarged bottom view of the water line nipple 36 is shown with the small orifice 40 therein.

While the invention has been particularly shown, described and illustrated in detail with reference to the preferred embodiments and modifications thereof, it should be understood by those skilled in the art that equivalent changes in form and detail may be made therein without departing from the true spirit and scope of the invention as claimed except as precluded by the prior art.

The embodiments of the invention for which as exclusive privilege and property right are claimed and defined as follows:

1. A hydrogen oxygen generator used for converting water to hydrogen and oxygen, which is mixed with fuel to a vehicle engine for improved mileage and cleaner burning fuel, the generator comprising:

a generator housing adapted for mounting to a side of an engine air duct manifold;

a water line nipple with an orifice in a range of 0.015 to 0.030 inches, the water line nipple is attached to a side of the generator housing;

a water line adapter connected to the threaded water line nipple;

a water line connected to the water line adapter, the water line for supplying water to the water line adapter and the water line nipple; and a threaded gas nipple attached to a side of the generator housing and adapted for connecting to the engine manifold;

whereby when the water passes through the orifice in the water line nipple, a venturi effect is created and the water is converted to hydrogen gas and oxygen gas, the two gases pass through the threaded gas nipple in the side of the generator housing, into the engine manifold, and then mixed with the engine fuel.

2. The generator as described in claim 1 further including a water container connected to the water line for supplying water to water line adapter.

3. The generator as described in claim 2 wherein the water container has a size in a range of 10 to 12 ounces and greater.

4. The generator as described in claim 1 wherein the water line is ½ inch in diameter.

5. A hydrogen oxygen generator used for converting water to hydrogen and oxygen, which is mixed with fuel to a vehicle engine for improved mileage and cleaner burning fuel, the generator comprising:

a generator housing adapted for mounting to a side of an engine air duct manifold;

a threaded water line nipple with an orifice 0.010 inches, the water line nipple is attached to a side of the generator housing;

a water line adapter connected to the threaded water line nipple, the water line adapter having barbs along its length;

a water line connected to the water line adapter, the water line for supplying water to the water line adapter and the water line nipple; and a threaded gas nipple attached to a side of the generator housing and adapted for connecting to the engine manifold;

whereby when the water passes through the orifice in the water line nipple, a venturi effect is created and the water is converted to hydrogen gas and oxygen gas, the two gases pass through the threaded gas nipple in the side of the generator housing, into the engine manifold, and then mixed with the engine fuel.

6. The generator as described in claim 5 further including a water container connected to the water line for supplying water to water line adapter.

7. The generator as described in claim 5 wherein the water container has a size in a range of 10 to 12 ounces and greater.

8. A hydrogen oxygen generator used for converting water to hydrogen and oxygen, which is mixed with fuel to a vehicle engine for improved mileage and cleaner burning fuel, the generator comprising:

a generator housing adapted for mounting to a side of an engine air duct manifold;

a threaded water line nipple with an orifice 0.010 inches, the water line nipple is attached to a side of the generator housing;

a water line adapter connected to the threaded water line nipple, the water line adapter having barbs along its length;

a water line connected to the water line adapter, the water line for supplying water to the water line adapter;

a water container connected to the water line for supplying water to water line adapter and the water line nipple, and a threaded gas nipple attached to a side of the generator housing and adapted for connecting to the engine manifold;

whereby when the water passes through the orifice in the water line nipple, a venturi effect is created and the water is converted to hydrogen gas and oxygen gas, the two gases pass through the threaded gas nipple in the side of the generator housing, into the engine manifold, and then mixed with the engine fuel.

9. The generator as described in claim 8 wherein the water container has a size in a range of 10 to 12 ounces and greater.

* * * * *